US005564940A

United States Patent [19]

Rodriques et al.

[11] Patent Number: 5,564,940

[45] **Date of Patent: *Oct. 15, 1996**

[54] ELECTRICAL CONNECTOR HAVING A CONDUCTOR HOLDING BLOCK

[75] Inventors: Julio F. Rodriques, Collierville; Paul J. Bartholomew, Memphis, both of Tenn.

[73] Assignee: Thomas & Betts Corporation, Memphis, Tenn.

[ * ] Notice: The term of this patent shall not extend beyond the expiration date of Pat. No. 5,538,440.

[21] Appl. No.: 449,148

[22] Filed: May 24, 1995

Related U.S. Application Data

[63] Continuation of Ser. No. 153,687, Nov. 17, 1993, Pat. No. 5,372,513.

[51] Int. Cl.[6] ..... H01R 4/24

[52] U.S. Cl. ..... 439/404

[58] Field of Search ..... 439/395, 397, 439/399, 452, 402, 403, 404, 417

[56] References Cited

U.S. PATENT DOCUMENTS

| | | | |
|---|---|---|---|
| 4,891,019 | 1/1990 | Olsson | 439/404 OR |
| 4,897,041 | 1/1990 | Heiney et al. | 439/404 OR |
| 5,030,143 | 7/1991 | Hatagishi | 439/395 X |
| 5,295,857 | 3/1994 | Toly | 439/417 X |

*Primary Examiner*—P. Austin Bradley
*Assistant Examiner*—Daniel Wittels
*Attorney, Agent, or Firm*—Michael L. Hoelter; Salvatore J. Abbruzzese

[57] ABSTRACT

An electrical connector provides for the termination of discrete insulated conductors of a multi-conductor cable. The connector includes an insulative connector housing supporting plural electrical contacts having insulation displacing contact portions. A conductor holding block is movably supported by the housing with respect to the insulation displacing contact portions. The conductor holding block includes contact slots for receipt of the insulation displacing contact portions. The conductor holding block further includes passages in communication with the contact slots for receipt of the conductors. Deflectable fingers extend into the passages to provide for support of the conductors and for the accurate alignment of the conductors over the insulation displacing contact portions upon movement of the conductor holding block with respect to the electrical housing.

7 Claims, 5 Drawing Sheets

ELECTRICAL CONNECTOR HAVING A CONDUCTOR HOLDING BLOCK

This is a continuation of application Ser. No. 08/153,687, filed Nov. 17, 1993, now U.S. Pat. No. 5,372,513.

FIELD OF THE INVENTION

The present invention relates generally to improvements in electrical data connectors. More particularly the present invention relates to a shielded compact data connector which permits the transmission of signals at high data rates.

BACKGROUND OF THE INVENTION

In the field of data/communications technology, information in the form of electrical signals is being transmitted at ever increasing speeds. Along with the desire to transmit information at faster data rates, the industry has also seen the need to reduce the size of hardware employed so as to increase portability and ease of use. In order to keep pace with these improvements, the interconnection technology, which includes electrical cables and electrical connectors designed to connect such hardware, has also undergone significant changes. Electrical connectors and cables are now available which are much smaller in size and capable of transmitting data at higher rates.

Continued improvement in connection technology is not without problems. When decreasing the size of electrical connectors while requiring the connectors to transmit data at higher rates, cross-talk between adjacent conductive components of the connector becomes a factor which must be addressed. Additionally, as these components are normally used in close proximity to other electronic components, the individual connector components must be shielded from electro-magnetic interferences and radio-frequency interferences. These interferences can adversely affect the performance levels of the connectors especially at higher data rates.

An additional demand on connector technology is that the connector components must be "user friendly". That is, the components must be easy to assemble as well as easy to connect and disconnect. Further, the portability of many electronic components requires that these connections and disconnections be repeated many times. A connector must be able to withstand the rigors of repeated interconnection without degradation of mechanical or electrical performance.

It can be appreciated that merely "downsizing" a connector will be insufficient to meet the current requirements of the industry. Smaller connectors must be designed to meet increased signal transmission requirements, and provide for internal and external shielding as well as long term reliable mechanical performance.

SUMMARY OF THE INVENTION

It is an object of the present invention to provide an electrical connector for terminating discrete conductors of a multi-conductor cable.

It is a further object of the present invention to provide a conductor holding block for supporting conductors in position for termination with contacts of an electrical connector.

It is a still further object of the present invention to provide a conductor holding block which accurately supports conductors of a multi-conductor cable adjacent insulation displacing contacts of a connector for termination therewith.

In the efficient attainment of these and other objects, the present invention provides an electrical connector for terminating individually insulated conductors of a multi-conductor cable. The connector includes an insulative housing which supports plural electrical contacts therein. The contacts include aligned insulation displacing contact portions. A conductor holding block is movably supported by the housing for movement with respect to the insulation displacing contact portions. The conductor holding block includes individual contact slots for receipt of the insulation displacing contact portions upon movement of the holding block with respect to said housing. The conductor holding block further includes conductor receiving passages in communication with the contact slots for receipt of the individually insulated conductors of the cable and for alignment of the conductors with the insulation displacing contact portions.

As more particularly described by way of the preferred embodiment herein, the conductor holding block further includes deflectable conductor engaging fingers extending into the passages of the holding block for frictionally supporting the individual conductors in non-moveable disposition within the passages so as to accurately align the conductors with respect to the insulation displacing contact portions upon movement of the holding block thereover. The holding block further includes funnel entry openings to assist in the insertion of the individual conductors into the passages.

DETAILED DESCRIPTION OF THE PREFERRED EMBODIMENT

Figure 1:
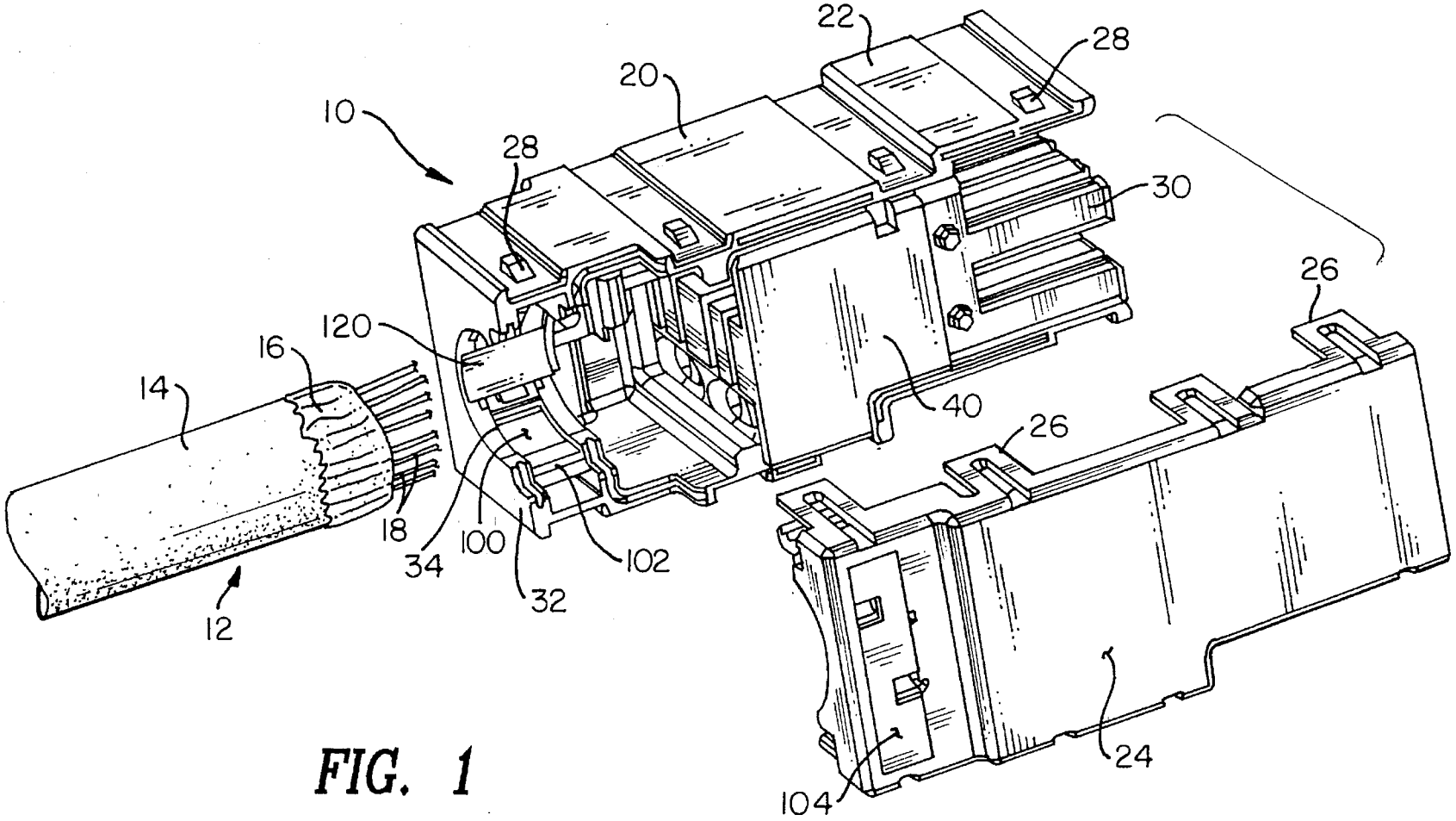
FIG. 1 shows an exploded perspective view of the compact data connector of the present invention and a shielded multi-conductor electrical cable positioned for termination therewith.

Referring to FIG. 1 a compact electrical data connector 10 is shown. Connector 10 may be employed to terminate electrical cable 12 having an insulative outer jacket 14, an inner conductive cable shield 16 and a plurality of individually insulated electrical conductors 18 extending therethrough. In order to prepare cable 12 for termination in connector 10, jacket 14 is cut away exposing a portion of cable shield 16 and a length of conductors 18 suitable for termination.

In the present illustrated embodiment cable 12 is an eight conductor cable. However, it may be appreciated that the invention may be employed with cables having greater or fewer conductors. Also, cable shield 16 is shown to be a metallic foil shield, however cables having other types of conductive shields, such as metallic braiding, may also be employed in accordance with the present invention. Connector 10 includes an outer connector housing 20 formed in two parts, a housing base 22 and a housing cover 24. Housing cover 24 includes a plurality of depending deflectable locking arms 26 which engage protrusions 28 on base 22 to provide for snap fit engagement of cover 24 on base 22. Other similar snap fitting elements may also be employed to secure cover 24 to base 22. Housing 20 may be formed of a suitably electrically insulative plastic such as polyester. In order to provide external electrical shielding which shields the connector 10 from external interferences such as radio-frequency interferences and electro-magnetic interferences, both base 22 and cover 24 may be internally and externally electrolessly plated with a metallic plating such as nickel/copper. The process of metallically plating a plastic member may be accomplished in a manner which is conventional in the art.

Figure 8:
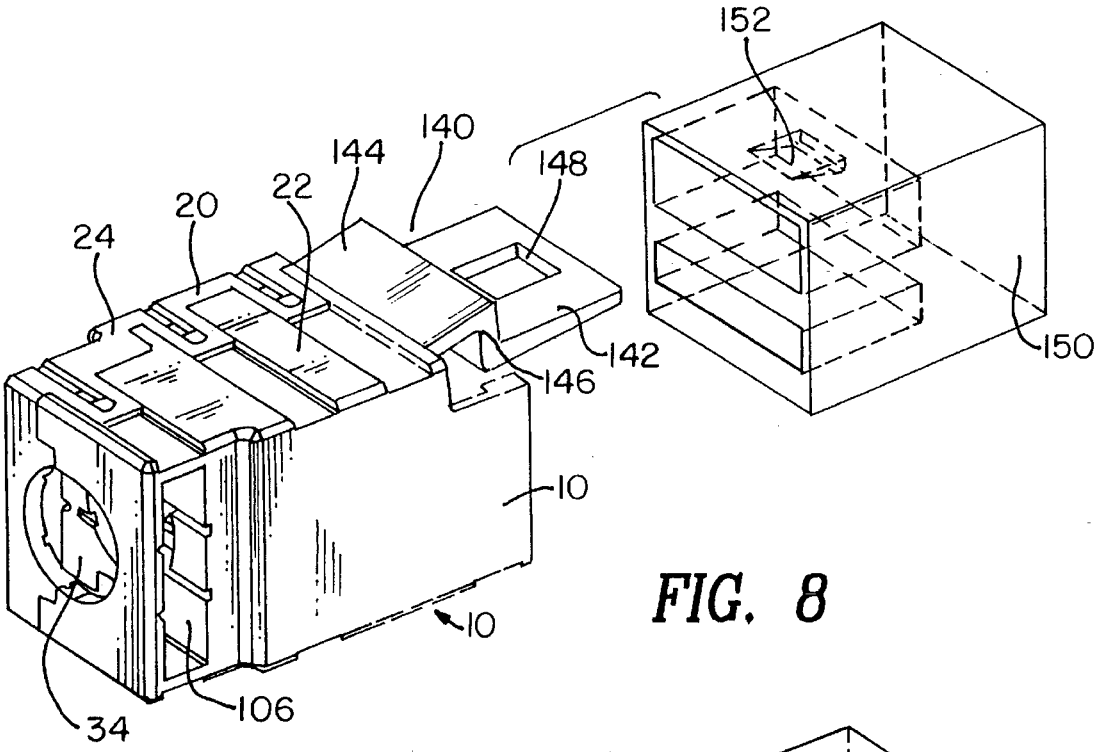
FIG. 8 is a perspective view the connector of FIG. 1 including a latch for attachment to a mating connector.

Housing 20 is generally an elongate rectangular member having a connection end 30 and an opposed cable receiving end 32. Housing 20 shown in FIG. 1 is a plug type electrical connector where connection end 30 is insertable into a jack type electrical connector for mating engagement therewith (FIG. 8). While a plug connector 10 is shown, the concepts of the present invention may also be employed in a jack connector configuration.

Figure 9:
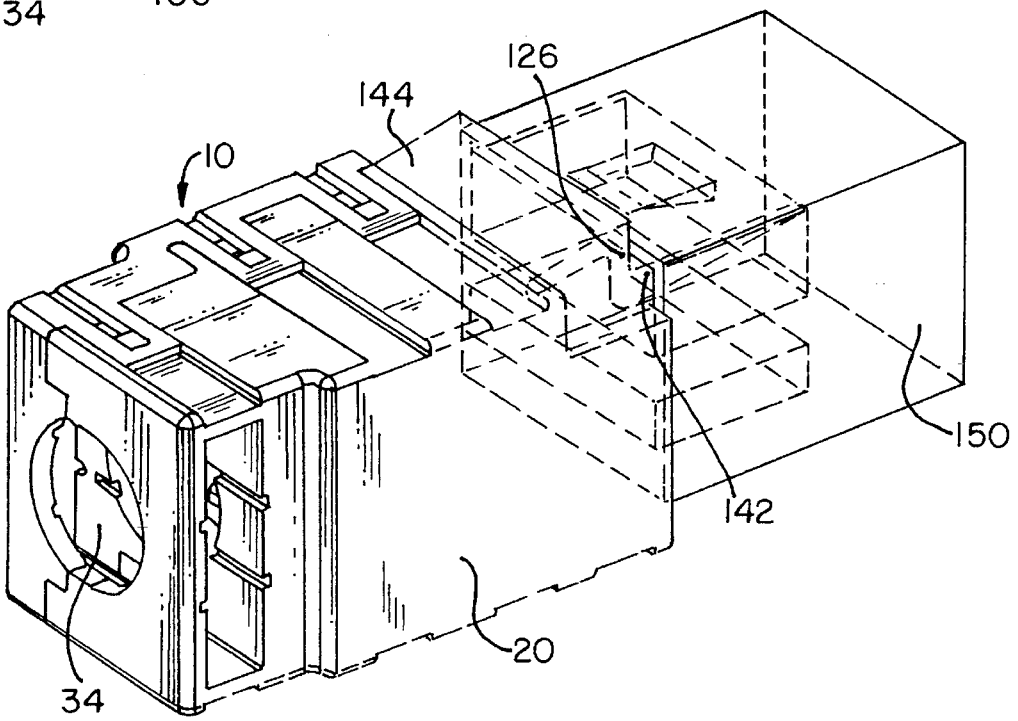
FIG. 9 shows the connector of FIG. 8 in connected position with the mating connector.

Cable receiving end 32 of connector 10 defines a rearwardly opening circular passage 34, more clearly shown in FIGS. 8 and 9, which permits entry of cable 12 into connector 10.

Figure 3:
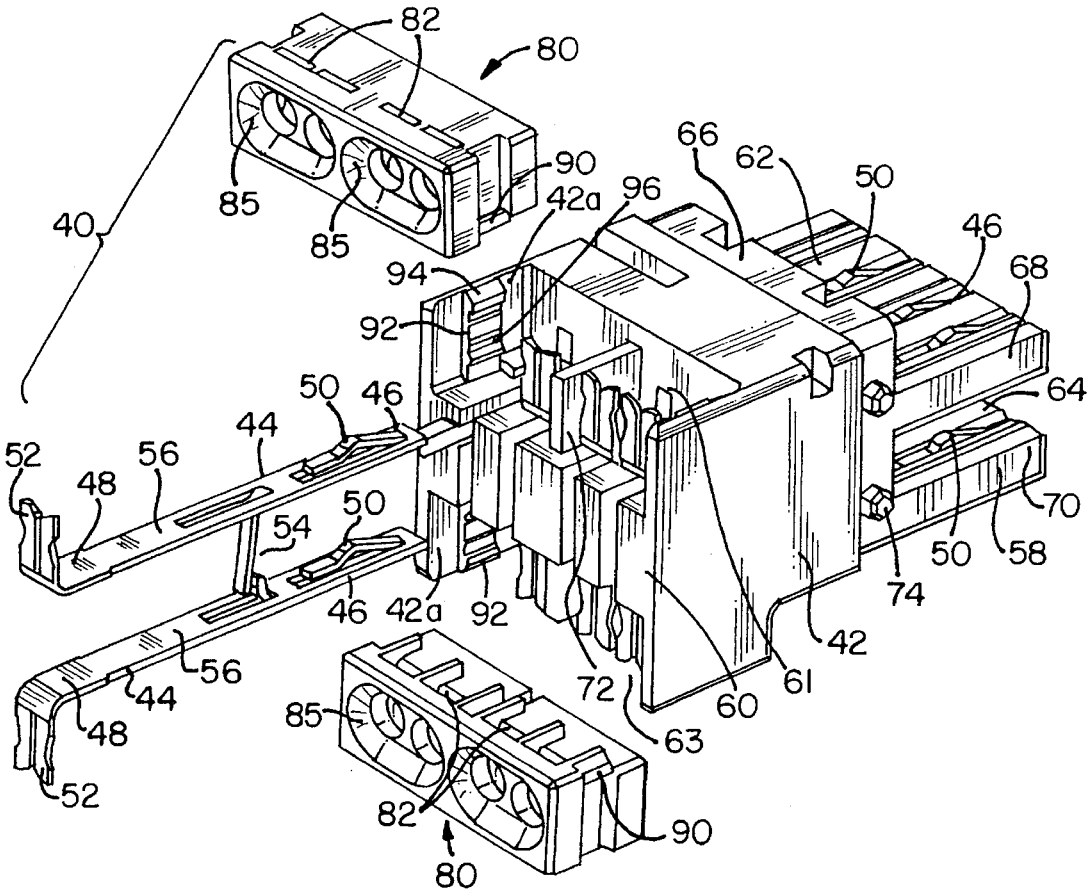
FIG. 3 is an exploded perspective view of a subassembly of the connector of FIG. 1.

Housing base 22 supports therein a termination sub-assembly 40. Referring additionally to FIG. 3 termination sub-assembly 40 is shown. Termination subassembly 40 includes a termination support member 42 formed of a suitably insulative plastic such as polyester, which supports a plurality of electrical contacts 44. Each of contacts 44 are elongate electrically conductive metallic members formed of beryllium-copper having a connection end 46 and a termination end 48. Connection end 46 includes a cantilevered element 50 for making mating resilient electrical engagement with similar contacts in the mating jack connector. Termination end 48 includes blade type insulation displacing contact (IDC) portions 52 which, as will be described in further detail hereinbelow, are constructed for insulation displacing termination with conductors 18 of cable 12.

In the present illustrative embodiment contacts 44 are positioned in two longitudinally aligned transversely spaced rows. Insulation displacing contact portions 52 of the lower row extend in a direction opposite of the insulation displacing contact portions 52 of the upper row. Contacts 44 further include a matable shunting mechanism 54 along a central extent 56 thereof. Shunting mechanism 54 permits the shunting engagement of the upper row of contacts 44 to the lower row of contacts 44. The operation of a shunting mechanism 54 of this type is shown and described in copending patent application Ser. No. 08/013,452 filed on Feb. 4, 1993 entitled "Vertically Aligned Electrical Connector Components" which is assigned to the assignee of the present invention.

Support member 42 of termination sub-assembly 40 includes a forward interconnection end 58 and a rear termination support end 60. Support member 42 supports contacts 44 in individual electrical isolation providing upper and lower forward platforms 62 and 64 which support the connection end 46 of contacts 44.

Figure 2:
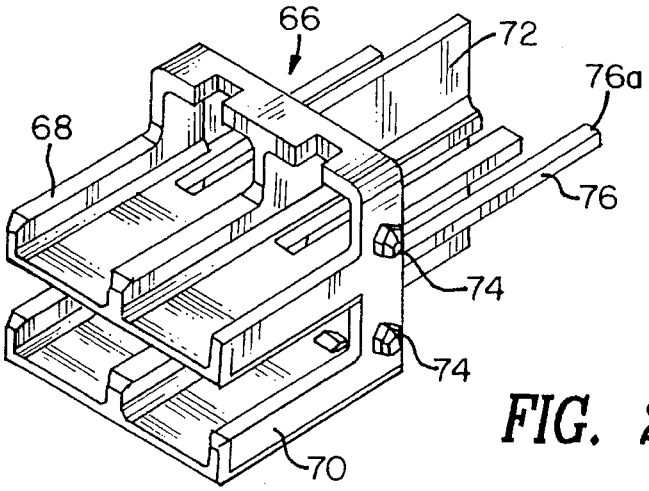
FIG. 2 is a perspective showing of the internal shield of the connector of FIG. 1.

As contacts 44 are maintained in close proximity in support member 42, it becomes necessary to shield individual contact pairs from adjacent contact pairs. Shown in FIG. 2 is an internal contact shield 66. Shield 66 is a die cast metallic member formed of zinc which is insertable over support member 42 from the interconnector end 58 thereof. Contact shield 66 serves to shield pairs of contacts 44 from one another both laterally and vertically. Contact shield 66 includes upper and lower shield platforms 68 and 70 which provide effective vertical shielding as between the connection ends 46 of contacts 44. Further, contact shield 66 includes a transverse wall 72 separating lateral pairs of contacts 44. Transverse wall 72 is especially effective in shielding the central portion 56 of contacts 44 including shunting mechanism 54 which extends to shunt vertically spaced contacts 44. Contact shield 66 further includes a plurality of extending contact bumps 74. As will be described in further detail hereinbelow, contact bumps 74 extend for engagement with metallically plated housing 20 of connector 10. This establishes electrical path continuity between housing 20 and contact shield 66. Contact shield 66 further includes an extending ground element 76 which extends for grounding electrical engagement with cable shield 16, as will be described in further detail hereinbelow, to maintain electrical ground continuity between cable shield 16 and contact shield 66.

Cable 12 is terminated to termination sub-assembly 40 prior to the insertion of termination sub-assembly 40 into base 22 of housing 20. Extending insulated conductors 18 of cable 12 are positioned for insulation displacing connection with IDC portions 52 of contacts 44. In order to accurately align conductors 18 with insulation displacing portion 52, the present invention provides a pair of polycarbonate conductor holding blocks 80 which are removably positionable with respect to support member 42. Each holding block 80 is sized to be accommodated within a recess 61 and 63 at the termination end 60 of support member 42. Further each holding block 80 is designed for positionable receipt over the upper and lower rows of contacts 44.

Figure 4:
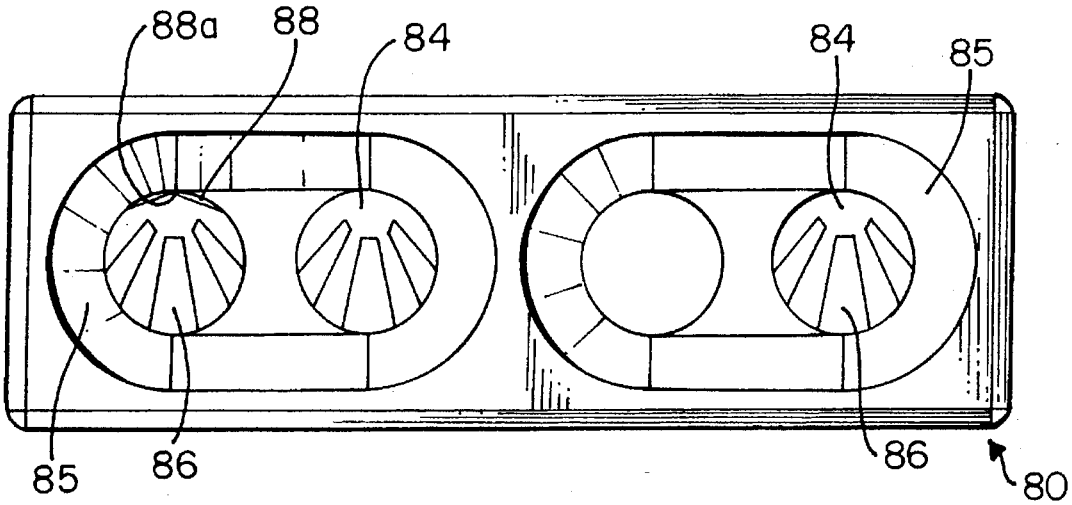
FIGS. 4 and 5 show in front plan and perspective views respectively, a conductor holding block used in the connector sub-assembly of FIG. 3.
Figure 5:
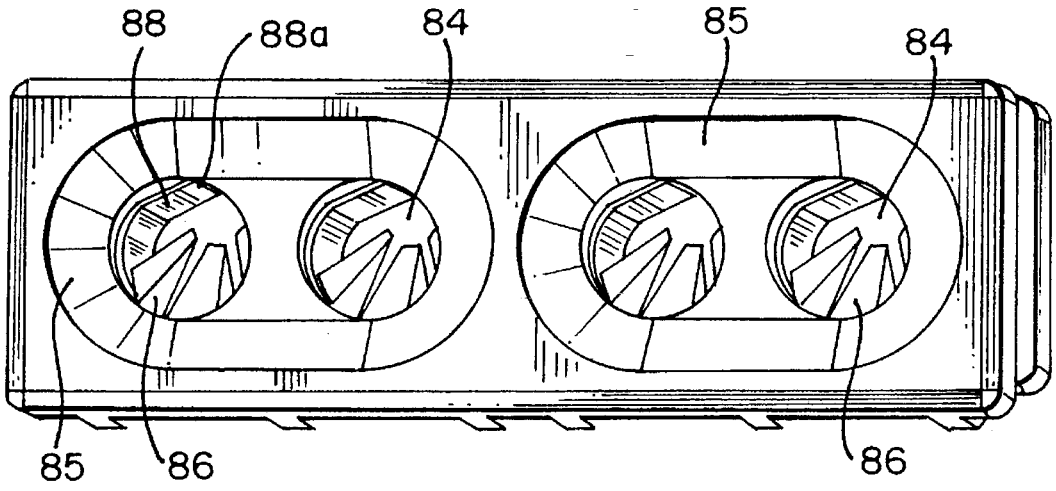

Referring additionally to FIGS. 4 and 5, each holding block 80 includes plural elongate contact slots 82 which are designed for accommodating insulation displacing contact portions 52 of contacts 44 upon attachment of holding block 80 to support member 42. Each holding block 80 includes individual slots 82 for uniquely accommodating each insulation displacing contact portion 52. Holding block 80 further includes plural elongate conductor passageways 84 which are in individual communication with slots 82. Each passageway 84 accommodates one conductor 18 of cable 12. In order to support conductor 18 for accurate alignment adjacent insulation displacing contact portion 52 for proper insulation displacing connection therewith, holding block 80 includes plural alignment fingers 86 extending into passageway 84. Fingers 86 help support conductors 18 adjacent an upper extent of passageway 84. The walls of holding block 80 defining passageway 84 include an upper V-shaped flattened surface 88. Fingers 86 extend toward the apex **88*a* of V-shaped surface 88 so as to permit the location of conductor 18 within the apex 88*a* of V-shaped surface 88**.

As shown particularly with respect to FIG. 4, the arrangement of fingers 86 and V-shaped surface 88 serves to locate conductor 18 at a position off-centered with respect to passageway 84. The fingers 86 engage the insulation of conductor 18. As the insulation of conductor 18 is deformable, the fingers 86 hold conductor 18 securely in passageway 84. Fingers 86 may also be resiliently deformable to further frictionally secure the conductor 18 in position for electrical termination with IDC portions 52 of contacts 44. The interaction between fingers 86 and conductor 18 permits proper location of conductor 18 and also accommodates various sizes of conductors.

Additionally, in order to facilitate entry of the individual conductors 18 into the individual passageways 84 holding block 80 includes a tapered funnel entry surface 85 surrounding two adjacent passageways 84. Funnel entry surface 85 is generally oval and tapers inwardly toward passageway 84 to provide a smooth inwardly directed surface against which conductors 18 may be inserted. Funnel entry surface 85 serves to lead conductors 18 into proper position within passageway 84.

In order to properly position holding block 80 with respect to support member 42, a ratcheting inter-lock system is employed. Holding block 80 includes a projecting detent element 90 on each longitudinal side thereof. Support member 42 includes inwardly directed ladder-type detent receiving elements 92. Detent receiving elements 92 are positioned on opposed internal side surfaces 42*a* of support member 42 within recesses 61 and 63. Each detent receiving element 92 includes a tapered lead-in surface 94 and plural positioning elements 96 which permit the holding block 80 to be supported in multiple positions within support member 42. Initially, holding block 80 is supported below lead-in surface 94. In this position, conductors 18 may be inserted into passageways 84 to align the conductors over insulation displacing contact portions 52. The holding block 80 may be snapped down to either of the next two positions to secure the conductors 18 against, but not in electrical connection with, IDC portions 52. Two intermediate positions are provided so as to properly position various sizes of conductors which are contemplated to be terminated by the connector of the present invention. Holding block 80 may be snapped down to a final position forcing IDC portions 52 fully through slots 82 and past passageway 84 to make insulation displacing connection with conductors 18. In this final position holding block 80 securely supports conductors 18 in insulation displacing electrical connection with contacts 44.

It is contemplated that both holding blocks 80 may be simultaneously moved from an initial position to a final terminated position under the actuation of a suitable tool such as pliers (not shown). Movement in this manner will provide for the mass termination of all eight conductors 18 with the associated insulation displacing contact portions 52.

With termination sub-assembly fully assembled and terminated to conductors 18 of cable 12, the termination sub-assembly 40 and cable 12 may be inserted into base 22 of housing 20. Termination sub-assembly 40 is inserted into base 22 adjacent connection end 30 thereof. Upon insertion of termination sub-assembly 40 into base 22, cable 12 is inserted into cable receiving end 32 of housing 20 and extends through passage 34 at the rear end thereof.

Figure 6:
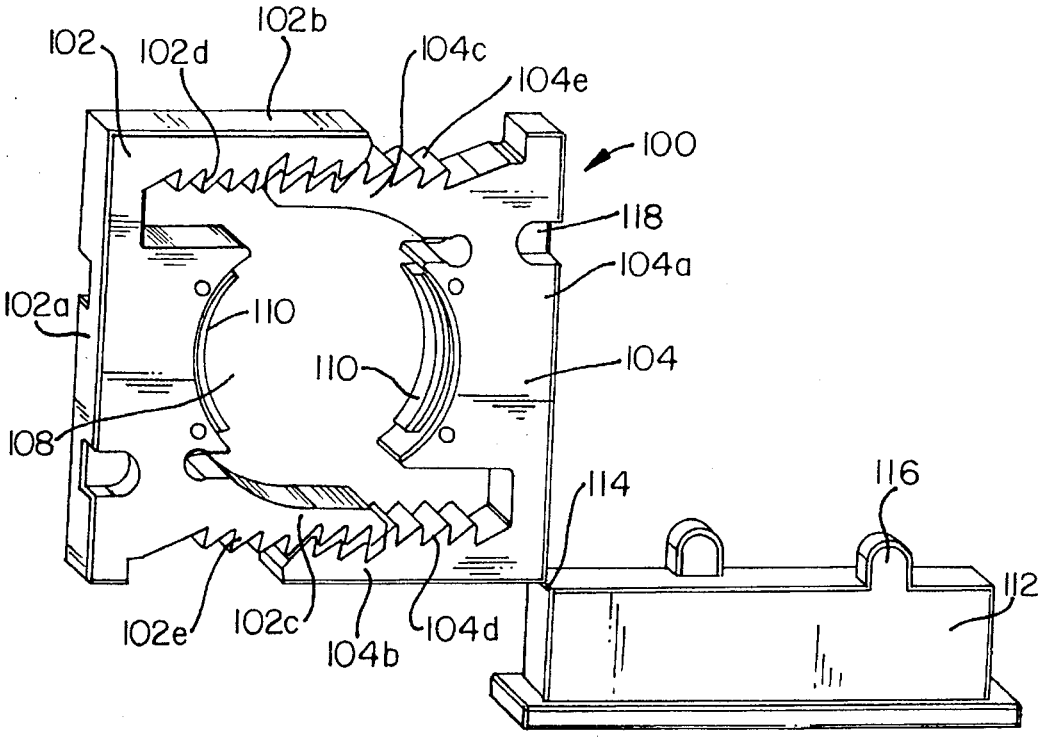
FIG. 6 is a perspective view a strain relief device used to secure the multi-conductor cable to the connector shown in FIG. 1.

The cable receiving end 32 of housing 20 includes a two-component strain relief device 100 which helps secure cable 12 in housing 20. Strain relief device 100 which is shown in more detail in FIG. 6 includes a pair of mating generally hermaphroditic strain relief components 102 and 104. Strain relief component 102 is referred to as a stationary component and is fixedly positioned in a channel 106 (FIG. 8) in base 22 adjacent cable receiving end 32. Strain relief component 104 is movably positioned within a similarly disposed slot in cover 24. Strain relief components 102 and 104 are generally U-shaped members having a bottom wall 102*a* and 104*a* respectively and upwardly extending sidewalls or legs 102*b*, 102*c* and 104*b*, 104*c*. Legs 102*c*, 104*c* are deflectable and include inwardly directed ratchet teeth 102*d* and 104*d* respectively. Legs 102*c* and 104*c* include outwardly directed ratchet teeth 102*e*, 104*e* respectively. The hermaphroditic strain relief components 102 and 104 are positioned so that leg 102*b* of component 102 engages leg 104*c* of component 104 and similarly leg 102*c* of component 102 engages leg 104*b* of component 104. The positioning of ratchet teeth 102*d*, 104*d* and 102*e*, 104*e* permit the movable one-way ratchet engagement of component 102 with respect to component 104. The deflectability of legs 102*c* and 104*c* permits such ratchet movement of components 102 and 104. The internal surfaces of legs 102*c*, 104*c* as well as the internal surfaces of bottom walls 102*a* and 104*a* are generally curved so as to form a circular opening 108 which is generally concentric with passage 34 of housing 20.

As component 104 moves with respect component 102, opening 108 defined therebetween will be reduced in size in order to frictionally secure jacket 14 of cable 12 therebetween. In order to assist in this frictional securement, ribs 110 are provided on the internal surface of each bottom wall 102*a* and 104*a*. These ribs provide increased localized friction against the cable jacket 14.

Component 104 may also include a frangibly removable cap 112 which is attached to component 104 by a flexible web 114. Cap 112 includes inwardly directed protrusions 116 which are insertable into recesses 118 adjacent bottom wall 104*a* of component 104 for snap fit engagement therewithin.

Strain relief device 100 operates in the following manner. Strain relief component 102 is fixedly positioned within base 22 of housing 20. Strain relief component 104 is inserted into the slot in cover 24. Cover 24 is then positioned over and snap fitted on to base 22. In this position legs 102*b*, 104*b* and 102*c* and 104*c* are only in initial engagement. In order to provide strain relief for cable 12 within connector 10, strain relief component 104 is manually pushed down into housing 10 through cover 24 to provide for ratchet engagement of the respective teeth of legs 102*b*, 104*b* and 102*c*, 104*c*. Component 104 is pushed downward toward component 102 until the cable is secured within opening 108 which is continually decreasing in size by the movement of component 104 with respect to component 102. If cable 12 is of relatively small diameter, cap 112 may be attached to component 104 and be used as a pressing surface. With such relatively small cables, cap 112 will also function as a stop preventing over-insertion of component 104 and the possible of crushing of cable 12. In terminating larger cables, cap 112 may extend above the surface of cover 24 as component 104 need not be inserted as deeply into base 20. In this situation in order to maintain a flat profile of cover 24, cap 112 may be frangibly removed from component 104 and discarded.

Prior to installation of cable 12, cable shield 16 is folded back over an extent of jacket 14. Thus the cable shield will also be secured between strain relief components 102 and 104. As the connector 10 is metallized, conductive continuity may be established between cable shield 16 and housing 20. Additionally, as contact shield 66 is in electrical engagement with metallized housing 20 through extending bumps 74 thereon, conductive continuity is maintained between cable shield 16 and contact shield 66 through metallized housing 20. However, in order to provide further redundant direct conductive continuity between cable shield 16 and contact shield 66, a ground clip 120 is employed.

Figure 7:
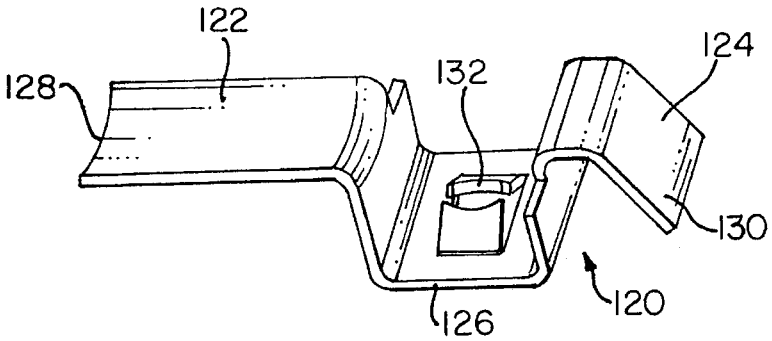
FIG. 7 is a perspective showing of a ground clip employed in the connector shown in FIG. 1.

Ground clip 120 which is shown in more detail in FIG. 7 is positioned adjacent strain relief device 100 for engagement with cable shield 16 upon strain relief termination of cable 12 in housing 20. Ground clip 120 is an elongate member formed of conductive metal such as plated copper. Ground clip 120 includes a cable engagement extent 122, an opposed contact shield engaging extent 124 and a central mounting surface 126. Cable engagement extent 122 includes a transversely arcuate cable engaging surface 128 for positioning of cable 12 thereon. Shield engagement extent 124 includes a deflectable cantilevered arm 130 for engagement with extending ground element 76 of contact shield 66. Ground clip 120 is positioned within housing base 22 so that cable engagement extent 122 overlies fixed strain relief component 102. Ground clip 120 is secured within base 22 employing a pair of inwardly directed deflectable locking barbs 132 at central mounting surface 126. An appropriate post (not shown) extends from a wall of base 22 to be received between locking barbs 132 to secure ground clip 120 thereat. Shield engagement extent 124 extends toward connection end 30 of housing 20 for engagement with ground element 76 of contact shield 66 upon insertion of contact shield 66 into base 22. Cantilevered arm 130 is deflectable so as to resiliently engage an end 76*a* (FIG. 2) of contact shield 66 upon termination of cable 12 in housing 20. Ground clip 120 establishes electrical continuity between cable shield 16 and contact shield 66 directly without need to employ the metallic plating of housing 20 to establish such continuity.

Referring now to FIGS. 8 and 9 the latching of connector 10 to a mating connector is shown. Connector 10, which as above mentioned is a plug connector, may be mechanically and electrically mated with a complementary jack connector shown schematically as jack connector 150. Connector 10 is designed for repeated connection and disconnection with jack connector 150. In order to provide for such repeated connections and disconnections, connector 10 includes a deflectable latch 140 extending therefrom. Connector 10 which is shown in a position rotated 180° from that shown in FIG. 1, includes latch 140 extending from a side wall of housing base 22. Latch 140 is generally a deflectable cantilevered member having a distal latching surface 142, a proximal manual actuating surface 144 and a central transition surface 146. Latching surface 142 and manual actuating surface 144 extend generally longitudinal to connector housing 20. Latching surface 142 and manual actuation surface 144 are vertically spaced apart being connected by transversely extending transition surface 146. The particular shape of latch 140 provides for a low profile configuration of the latch. Connector 10 generally has a rectangular body profile defined by base 22 and cover 24. Employing an extending simple cantilevered arm which would extend from housing 20, would require the distal end of the latch to be substantially outward of the rectangular body profile of connector 10. This would result in the presentation of a wider body profile which would be generally unacceptable for use with compact components. Also in order to appropriately latch such an extending arm a greater degree of deflection would be required. The latch 140 of the present invention overcomes these disadvantages by providing a latching surface 142 which is within the body profile of housing 20 upon latching engagement with connector 150.

Connector 10 is connected to jack connector 150 in the following manner. The connection end 30 of connector 10 is inserted into jack connector 150, latch 140 which is designed to downwardly deflect upon insertion into connector 150, engages a downwardly ramped latch element 152 of connector 150. This engagement forces latching surface 142 under ramped latch element 152. An opening 148 in latching surface 142 rides over ramped latch element 152 and into locked position therewith.

Referring to FIG. 9 the latched position of connector 10 with respect to connector 150 is shown. Latching surface 142 is secured within connector 150 with opening 148 in latching surface 142 surrounding latch element 152 to secure connectors 10 and 150 in latching engagement. In order to release the latch 150 and disconnect connector 10 from connector 150 manual actuation surface 144 is depressed. Since manual actuation surface 144 is positioned in the plane above the plane of latching surface 142, the manual actuation surface 144 may be easily manipulated by the user. By depressing manual actuation surface 144 latching surface 142 is moved away from ramped latch element 152 permitting disconnection of connector 10 from connector 150.

The present invention thus provides a low profile latch almost entirely within the body profile of connector 10 with only manual actuation surface 144 slightly extending above the body profile of connector 10 to facilitate manual actuation and release of connector 10 from connector 150.

Various changes to the foregoing described and shown structures would now be evident to those skilled in the art. Accordingly the particularly disclosed scope of the invention is set forth in the following claims.

What is claimed is:

1. An electrical connector for terminating discrete insulated electrical conductors of a multi-conductor cable comprising:

an electrically insulative connector housing;

plural electrical contacts supported in said housing, said contacts having insulation displacing contact portions for effecting insulation displacing electrical connection with said conductors;

a conductor holding block having plural conductor receiving passages for individually accommodating said conductors and plural contact slots in individual communication with said conductor receiving passages for accommodating said insulation displacing contacts portions;

said holding block being movably supported by said housing for movement from a conductor receiving position permitting unrestricted insertion of said conductors into said passages to a termination position wherein said insulation displacing electrical connection is effected; and said holding block and said housing including cooperative securement elements for mechanically detaining said holding block with respect to said housing at a discrete intermediate position between said conductor receiving position and said termination position, said intermediate position defining a temporary conductor support position for retentively supporting said conductors against said insulation displacing contact portion without effecting said insulation displacing connection.

2. An electrical connector of claim 1, wherein said cooperative securement elements define plural, discrete positions in which said holding block is supported with respect to said housing including said conductor receiving position and said termination position.

3. An electrical connector of claim 2, wherein said cooperative securement elements further detain said holding block with respect to said housing in plural discrete intermediate positions including:

a first intermediate position for accommodating conductors of a given size; and a second intermediate position for accommodating conductors of a size different from said given size.

4. An electrical connector of claim 3, wherein said cooperative securement elements include:

said holding block including a detent member extending therefrom; and said housing including plural spaced detent receiving elements each engageable with said detent member of said holding block for captively supporting said holding block, said detent member being engageable with a first said detent receiving element to define said first intermediate position and being engageable with second said detent receiving element to define said second intermediate position.

5. An electrical connector of claim 4, wherein said holding block is an elongate member having one said detent member at each end thereof and wherein said housing includes said detent receiving elements at opposed housing location.

6. An electrical connector of claim 4, wherein each said detent member is engageable with a third detent receiving element to define said conductor receiving position.

7. An electrical connector of claim 6, wherein said detent member is engageable with a fourth detent receiving element to define said termination position.

* * * * *